US007671330B2

(12) United States Patent
Reilly et al.

(10) Patent No.: US 7,671,330 B2
(45) Date of Patent: Mar. 2, 2010

(54) HIGH RESOLUTION MASS SPECTROMETRY METHOD AND SYSTEM FOR ANALYSIS OF WHOLE PROTEINS AND OTHER LARGE MOLECULES

(75) Inventors: Peter T. A. Reilly, Knoxville, TN (US); William A. Harris, Naperville, IL (US)

(73) Assignee: UT-Battelle, LLC, Oak Ridge, TN (US)

( * ) Notice: Subject to any disclaimer, the term of this patent is extended or adjusted under 35 U.S.C. 154(b) by 325 days.

(21) Appl. No.: 11/688,996

(22) Filed: Mar. 21, 2007

(65) Prior Publication Data

US 2008/0230692 A1 Sep. 25, 2008

(51) Int. Cl.
*H01J 27/00* (2006.01)

(52) U.S. Cl. ..... 250/290; 250/281; 250/284; 250/288

(58) Field of Classification Search ..... None
See application file for complete search history.

(56) References Cited

U.S. PATENT DOCUMENTS

| | | | | |
|---|---|---|---|---|
| 6,943,346 | B2 * | 9/2005 | Tan et al. | 250/288 |
| 6,974,957 | B2 * | 12/2005 | Glukhoy | 250/427 |
| 7,256,396 | B2 * | 8/2007 | Reilly | 250/288 |
| 2005/0035285 | A1 * | 2/2005 | Tan et al. | 250/288 |
| 2005/0230615 | A1 * | 10/2005 | Furutani et al. | 250/287 |
| 2009/0218481 | A1 * | 9/2009 | DeWalch | 250/281 |

OTHER PUBLICATIONS

Karas et al. "Laser Desorption Ionization of Proteins with Molecular Masses Exceeding 10000 Daltons", Anal. Chem., (1998), vol. 60, pp. 2299-2301.

Ding et al. "A digital ion trap mass spectrometer with atmospheric pressure ion sources", Journal of Mass Spectrometry, (2004), vol. 39, pp. 471-484.

Harris et al. "MALDI of Individual Biomolecule-Containing Airborne Particles in an Ion Trap Mass Spectrometer", Anal. Chem., (2005), vol. 77, pp. 4042-4050.

Harris et al. "Aerosol MALDI of peptides and proteins in an ion trap mass spectrometer: Trapping, resolution and signal-to-noise", International Journal of Mass Spectrometry, (2006), vol. 258, pp. 113-119.

* cited by examiner

*Primary Examiner*—David A. Vanore
(74) *Attorney, Agent, or Firm*—Novak Druce + Quigg; Gregory A. Nelson; Gregory M. Lefkowitz

(57) ABSTRACT

A matrix assisted laser desorption/ionization (MALDI) method and related system for analyzing high molecular weight analytes includes the steps of providing at least one matrix-containing particle inside an ion trap, wherein at least one high molecular weight analyte molecule is provided within the matrix-containing particle, and MALDI on the high molecular weight particle while within the ion trap. A laser power used for ionization is sufficient to completely vaporize the particle and form at least one high molecular weight analyte ion, but is low enough to avoid fragmenting the high molecular weight analyte ion. The high molecular weight analyte ion is extracted out from the ion trap, and is then analyzed using a detector. The detector is preferably a pyrolyzing and ionizing detector.

16 Claims, 7 Drawing Sheets

HIGH RESOLUTION MASS SPECTROMETRY METHOD AND SYSTEM FOR ANALYSIS OF WHOLE PROTEINS AND OTHER LARGE MOLECULES

STATEMENT REGARDING FEDERALLY SPONSORED RESEARCH OR DEVELOPMENT

The United States Government has rights in this invention pursuant to Contract No. DE-AC05-00OR22725 between the United States Department of Energy and UT-Battelle, LLC.

CROSS REFERENCE TO RELATED APPLICATIONS

Not applicable.

FIELD OF THE INVENTION

The present invention relates to chemical analysis, and more particularly systems and matrix-assisted laser desorption/ionization (MALDI)-based methods combined with an ion trap mass spectrometer for chemical analysis.

BACKGROUND OF THE INVENTION

In 1988, matrix-assisted laser desorption/ionization time-of-flight (MALDI-TOF) mass spectrometry (MS) was introduced by Hillenkamp and Karas (*Anal. Chem.* 60:2288-2301, 1988), and, has since become a valuable tool for protein characterization and identification. Briefly, MALDI-TOF mass spectrometry is based on the ability to generate intact vapor-phase ions of large, thermally labile biomolecules by desorption/ionization from a matrix comprised of small volatile (matrix) molecules and the biomolecules or other large molecules to be studied. Pulsed laser radiation, that is absorbed by the matrix is used to initiate the desorption/ionization event and to simultaneously generate a packet of ions of having different mass-to-charge ratios (m/z). These ions are accelerated to the same electrostatic potential and allowed to drift an equal distance before striking a detector. The mass of the ions is determined by the flight times of the ions.

However, even with MALDI-TOF, there are difficulties in performing mass spectrometry in the high mass range (>30 kDa), and even more obstacles in performing mass spectrometry in the ultra high mass range (>100 kDa). There are three fundamental problems associated with mass spectrometry of high mass species. The first problem involves removal of the enormous amount of kinetic energy imparted to the high mass species in moving them from atmospheric pressure or a condensed matrix into vacuum during the ionization/vaporization process. The second problem is that most mass analyzers are not designed or are physically incapable of working in the high or ultra high mass range. Thirdly, there are challenges with detecting the analytes as a function of increasing mass-to-charge ratio. As known in the art, detection efficiency decreases significantly with increasing mass above approximately $10^4$ Da.

Consequently, large molecules such as proteins have to be fragmented or multiply charged so that they can be analyzed in the working range of the mass spectrometer. This makes quantitation and characterization of large molecules, such as proteins, very difficult and time consuming.

MALDI has been combined with an ion trap mass spectrometer, and MALDI has been practiced as aerosol MALDI. A paper by the two present inventors, Harris et al., entitled "Aerosol MALDI of peptides and proteins in an ion trap mass spectrometer", International Journal of Mass Spectrometry 258 (2006) 113-119, discloses utilizing the aerosol MALDI technique with a digital ion trap mass spectrometer. In a digital ion trap (DIT), quadrupole trapping and excitation waveforms are generated by rapid switching between discrete d.c. voltage levels. As the timing of the switch can be controlled precisely by available digital circuitry, this approach provides an opportunity to generate mass spectra using a frequency scan, in contrast to the conventional voltage scan used by conventional ion traps, thus providing a wider mass range of analysis. Such an arrangement is disclosed to be advantageous because the resolution and signal-to-noise ratio are not products of the laser ablation event. Trapping and detection of ions up to m/z 16.9 kDa (myoglobin) are disclosed in Harris et al. This Paper highlights the need for a method for injecting ions into the trap so that the working range of the spectrometer is not limited, such as to enable measurement of large molecules having a mass >20 kDa, but does not disclose or suggest a system for solving this need. Accordingly, there is a need for a new method for injecting ions into a DIT to extend the working mass range of a DIT-mass spectrometer, such as to enable mass spectrometry to permit real-time analysis of large molecules having a mass of over 20 kDa, such as proteins, viruses, whole DNA and RNA, whole bacteria, pollen and other ultra high mass species.

SUMMARY OF THE INVENTION

A method for analyzing high molecular weight analytes comprises the steps of providing at least one matrix-containing particle inside an ion trap. At least one high molecular weight analyte molecule is provided within the matrix-containing particle. Matrix assisted laser desorption/ionization (MALDI) is performed on the matrix-containing particle while within the ion trap. A laser power used for ionization is sufficient to completely vaporize the matrix-containing particle to form at least one high molecular weight ion, but is low enough to avoid fragmenting the high molecular weight ion. The high molecular weight ion is mass analyzed by sweeping or stepping the frequency to eject the ion as a function of mass. The ion is then detected using a detector.

The MALDI process preferably comprises aerosol MALDI so that MALDI takes place without a wall or surface for the vaporization plume to expand against. The matrix and analyte containing particle is completely vaporized so that the vaporization plume does not have a surface or a mass to expand against and thereby direct the plume. Complete vaporization requires that the velocity distribution of the analyte must be isotropic and center around zero relative to the center of mass of the particle. In order for the analyte ion to be trapped, the MALDI expansion-derived kinetic energy of the high molecular weight analyte ion must be less than an electronic charge multiplied by the pseudo-potential well depth in said mass spectrometer. Complete vaporization of the analyte-containing particle requires that some portion of the analyte ions produced by the aerosol MALDI process will have low enough expansion-induced kinetic energy to be trapped (because the velocity distribution centers at zero) and subsequently mass analyzed. Incomplete vaporization of the particle will result in a MADLI expansion induced analyte velocity distribution that approaches expansion from a surface and the analyte will not be trapped. The size of the particles that yield complete vaporization is generally <1 μm.

The analyzing step can comprise vaporizing the entire particle inside the ion trap away from the walls and ionizing the high molecular weight analyte by the MALDI process during the vaporization process. The high molecular weight analyte molecule can have a mass >20 kDa, such as a protein.

In another embodiment the analyte containing particles are introduced into the ion trap through an aerodynamic lens-based inlet system. In yet another embodiment the particle beam and the laser beam are collinear so that timing and aerodynamic sizing are not necessary and particles less than 200 nm may contain the analyte.

An aerosol matrix assisted laser desorption/ionization (MALDI) system for analyzing high molecular weight analytes comprising structure for providing at least one matrix-containing particle inside a digital ion trap (DIT), wherein at least one high molecular weight analyte molecule is provided within the matrix-containing particle, a laser having a beam aligned with the particle for ionizing said high molecular weight analyte while in the DIT. The laser includes a laser controller, wherein the laser controller controls output laser power to be sufficient for ionization and to completely vaporize the particle and form at least one high molecular weight ion, but low enough to avoid fragmenting the high molecular weight analyte ion. A mass spectrometer comprising a detector that receives the high molecular weight analyte ion as it is ejected from the trap as a function of mass, wherein the detector pyrolyzes the large analyte ion into small fragments and then ionizes those fragments and subsequently detects the small ionized fragments. Signal from the small ions at the detector represents the presence of large ions injected into the fragmenting and ionizing detector.

In one embodiment, the pyrolyzing and ionizing detector comprises a heated filament for pyrolyzing the particle into gaseous material and an ionization source for ionizing the gaseous material. In this embodiment, the pyrolyzing and ionizing detector can comprise a shrouded filament, where the shroud including a heat shield. In another embodiment, the system further comprises a ultra-high vacuum chamber for the pyrolyzing and ionizing detector, wherein a pressure in the ultra-high vacuum chamber is $<1\times10^{-9}$ torr.

BRIEF DESCRIPTION OF THE DRAWINGS

A fuller understanding of the present invention and the features and benefits thereof will be accomplished upon review of the following detailed description together with the accompanying drawings, in which:

FIG. 2(*b*) shows aerosol MALDI-DIT-mass spectrometer according to an exemplary embodiment of the invention which includes a ultra-high mass detector, such as a pyrolysis-based particle detector.

FIG. 3(*b*) is a cross sectional depiction of a modified pyrolysis-based particle detector which places the pyrolysis detector in its own ultra high vacuum chamber.

DETAILED DESCRIPTION OF THE INVENTION

Figure 1:
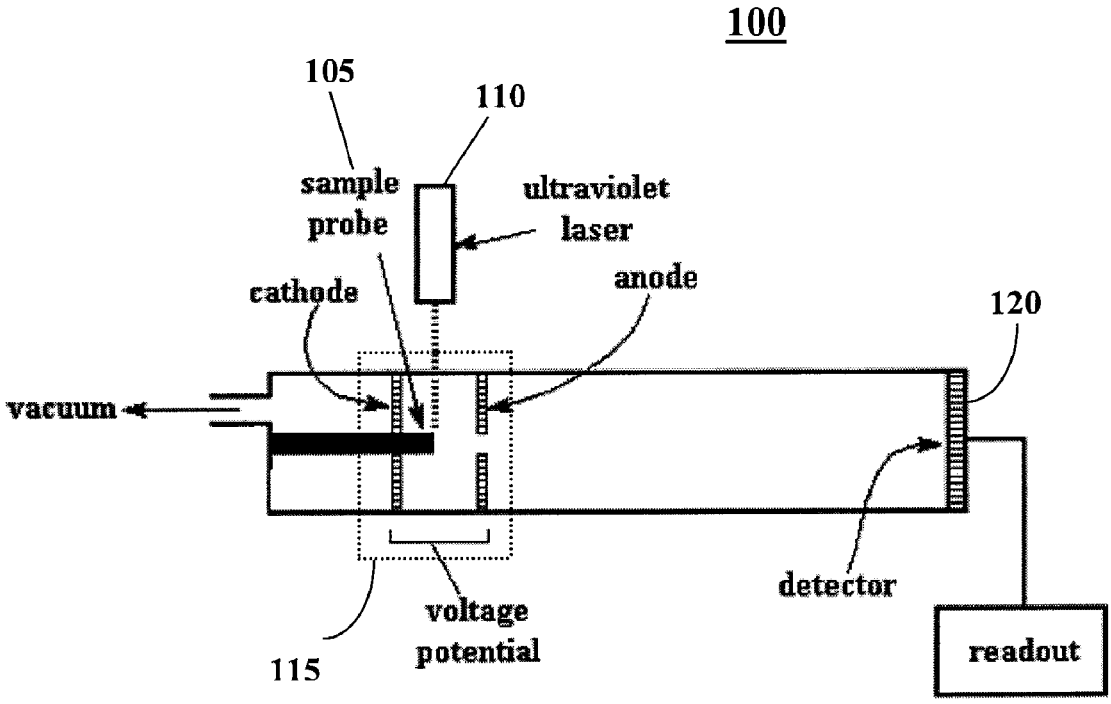
FIGURE 1 Prior Art
FIG. 1 is a simplified illustration of a conventional MALDI time-of-flight (TOF)-mass spectrometer having a sample plate.

FIG. 1 shows a simplified schematic illustration of a conventional MALDI TOF mass spectrometer 100. Spectrometer 100 includes a sample probe/plate 105. As well known in the art, MALDI is performed by mixing the analyte solution with a matrix solution, spotting a microliter of the mixture on the probe/sample plate 105, and allowing the solvent(s) to evaporate. The residue left behind contains analyte molecules imbedded within the (solid) matrix. The matrix enhances the desorption and ionization of sample molecules when the residue is irradiated with a laser beam from a pulsed laser 110, such as a uv laser operating at 337 nm. Spectrometer 100 includes an acceleration region 115, comprising two electrodes labeled anode and cathode only for convenience. The acceleration electrodes operate with DC potentials.

The sample plate 105 is within acceleration region 115. The UV laser 110 is aligned to irradiate sample plate 105 to provide sample molecular ions for analysis which are detected by detector 120. System 100 suffers from the two (2) of the three (3) problems described in the background which limits the ability to analyze high molecular weight analytes, including the enormous amount of kinetic energy imparted to the high mass species in moving them from a condensed matrix into vacuum during the ionization/vaporization process, and the detection efficiency of the detector decreasing significantly with increasing mass above approximately $10^4$ Da.

Instead of the sample plate 105 used by spectrometry system 100, the present invention preferably utilizes continuous-flow in the form of an aerosol to provide the sample for MALDI. Aerosol MALDI does not in itself solve the two (2) remaining problems associated with system 100 described above. As noted in the present background, there is a need for a new method and associated apparatus for injecting ions into a DIT that overcomes the problem regarding an enormous amount of kinetic energy imparted to the high mass species in moving them from atmospheric pressure or a condensed matrix into vacuum during the ionization/vaporization process, and to extend the working mass range of a DIT-mass spectrometer. Such a method, together with a sensitive detector, enables mass spectrometry to permit real-time analysis of large proteins, viruses, whole DNA, RNA or other ultra high mass species. The present invention provides such a method for extending the mass range and uses a new variant of aerosol MALDI.

A method for analyzing high molecular weight analytes comprises the steps of providing at least one matrix-containing particle inside an ion trap. At least one high molecular weight analyte molecule is within the matrix-containing particle. Matrix assisted laser desorption/ionization (MALDI) is performed on the matrix-containing particle while within the ion trap. A conventional ion trap or a DIT may be used. A conventional trap limits the mass range because the frequency is fixed. A DIT permits instantaneous changes in the trapping potential frequency so that advantageously any mass-to-charge ratio ion can be stored, excited or ejected. Moreover, the frequency of the trapping potential is completely and instantaneously adjustable, generally from zero to around five (5) MHz. The digitally generated trapping potential can be generated with great precision and accuracy to provide better resolution than is generally available from conventional ion trap systems.

A laser or other intense energetic beam having significant power is used for ionization, the wavelength and power selected being sufficient to completely vaporize the matrix to form at least one high molecular weight ion inside the trap, but low enough to avoid fragmenting of the high molecular weight analyte ion. The high molecular weight analyte ion then extracted out from the ion trap, such as in the case of a DIT by varying the frequency of the applied potential frequency. The high molecular weight analyte ion is then detected by a detector that permits analysis thereof. A thermal vaporization/ionization detector is a preferred detector due to the significant signal amplification provided for high mass ions.

The aerosol particle or particles used are preferably nanosize, being <1 μm in size, such as <100, 200, 300, 400, 500, 600, 700, 800 or 900 nm. One method for generating small aerosol particles is nebulizing from an analyte comprising solution, such as a commercially available Collison nebulizer. The resulting droplets can be small and the analyte can be diluted with a suitable solvent as desired.

The parameters of laser intensity and aerosol particle size can generally be used to provide complete vaporization without fragmentation of the high molecular weight analyte. At a given power, there is a maximum particle size for complete evaporation. However, increasing power too high can cause unwanted fragmentation. If there is a plurality of high molecular weight molecules in the particle(s) under these conditions, then interpretation of the mass spectra becomes very difficult. Reducing the size of the particles generally offers a better solution to increasing the laser power since the number of ions produced does not change significantly with particle mass.

Monodisperse matrix and analyte-containing particles having a very narrow size distribution so that they can be considered to have a singular size of any size in the prescribed range of sizes can be made in a laboratory known methods. By sampling matrix and known analyte containing particles into the spectrometer and measuring their MADLI mass spectra, the laser intensity which causes fragmentation to occur can be determined. This can be done as a function of particle size to yield the threshold for fragmentation as a function of particle size. These experiments could also yield a lower laser intensity limit where complete vaporization does not occur.

Figure 2A:
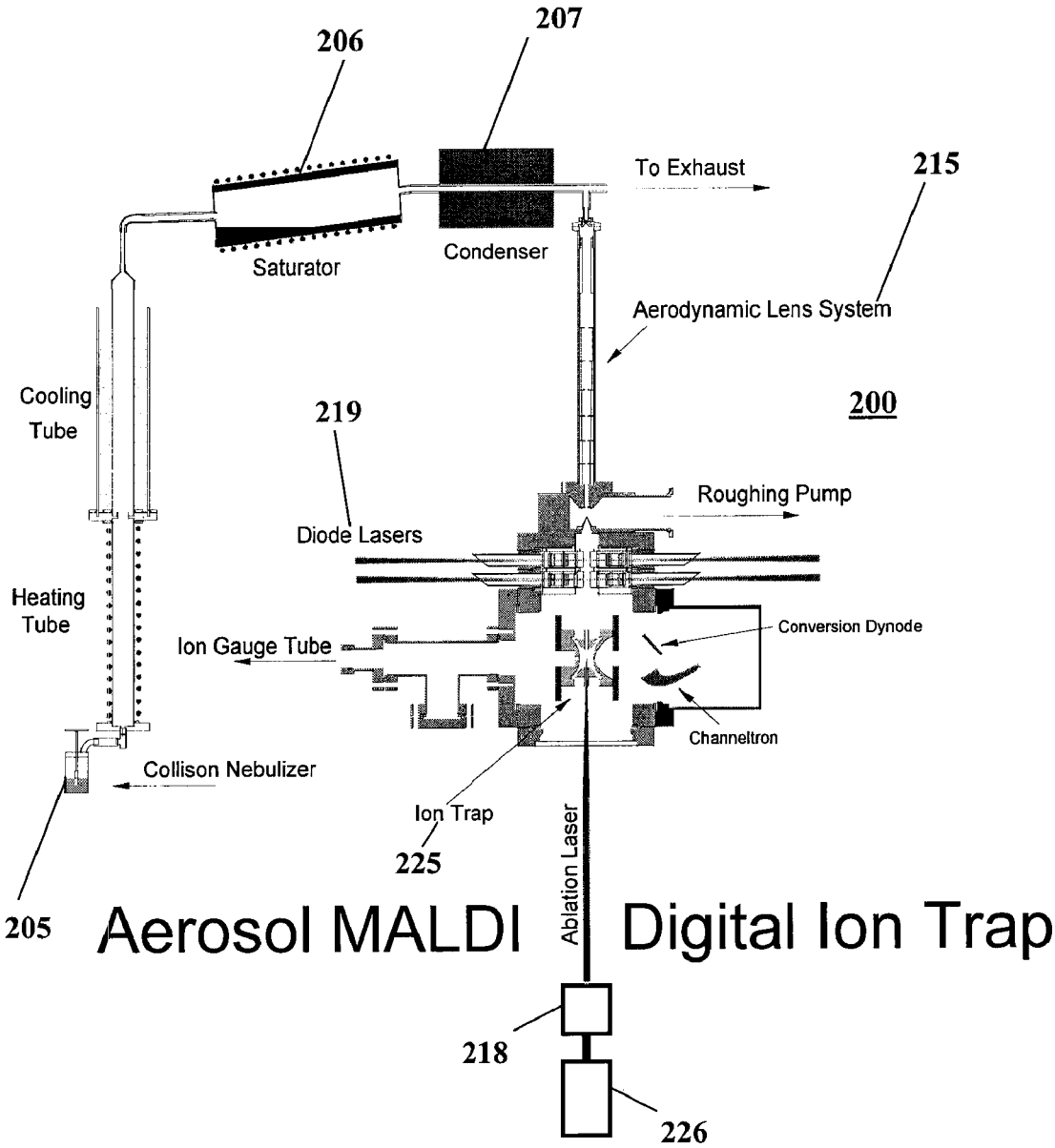
FIG. 2(*a*) shows an aerosol MALDI-DIT-mass spectrometer according to an exemplary embodiment of the invention having a conventional ion trap detector.
Figure 2B:
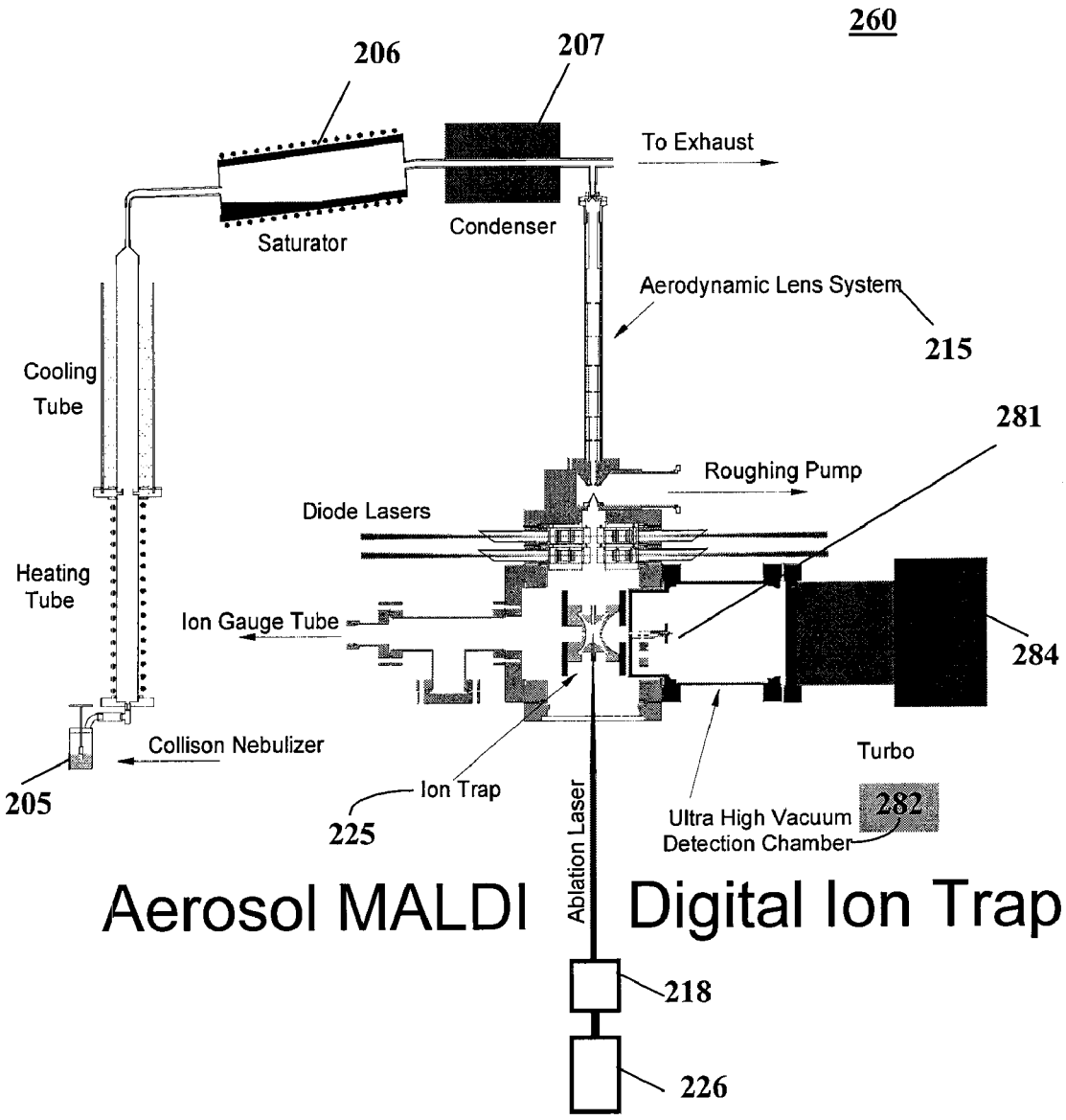

FIG. 2(*a*) shows an aerosol MALDI-DIT-mass spectrometer 200 according to an exemplary embodiment of the invention. For clarity purposes, a conventional ion trap detector is shown. Collison nebulizer 205 generates polydisperse biomolecule containing particles. The saturator 206 and condenser 207 shown are only necessary if it is desired to coat the particles on the fly. Generally, the saturator and condenser will not be necessary since the analyte and matrix will be premixed. Premixing generally yields better sensitivity. Aerodynamic lens system 215 forces the particles to the central axis of the lens system. DIT-mass spectrometer 226 comprises digital ion trap (DIT) 225, detection diode laser 219, ablation laser 218 having associated laser controller 226. DIT 225 can be based on commercial ion trap electrodes. Light scattering signals based on irradiation from detection lasers 219 are used to time of the firing of the ablation ion laser 218 which ionizes the particles while in the ion trap. The ions created in DIT 225, are trapped and subsequently subject to mass analysis.

An electron gun external to the trap 225 (not shown) can be used for low mass range calibration. The DIT chamber containing an electron gun can provide a gas inlet that can be used to produce charged species for chemical ionization. This provision permits the use of ion chemistry for characterization experiments such as the addition of anionic species to the ion trap for charge reduction. The trap has its own gas inlet so that the pressure just outside of the trap is substantially lower while the trap maintains an operating pressure of buffer gas (e.g. $1\times10^{-3}$ Torr He).

The potentials for the DIT and the multipole guides are preferably produced with field effect transistor (FET) technology. FET-based pulsers allow the high voltage DC potentials to be turned on and off. A function generator is used to gate the pulser to produce the high voltage potential waveform. The function generator permits instantaneous changes in the frequency of the potential. Charged species are removed from the trap by sweeping or changing the trapping potential frequency. A commercially available pulser permits waveform generation 1.5 MHz and 1,000 V continuously. It also operates at 200 V at 5 MHz. One centimeter radius commercial trap electrodes can be used to trap and eject any charged species from 1 to $10^{16}$ Da.

FIG. 2(*b*) shows an exemplary DIT mass spectrometer 260 which includes the same features as DIT mass spectrometer 200 shown in FIG. 2(*a*), but also includes a thermal vaporization/ionization-based detector 281, associated ultra high vacuum detection chamber 282, and turbo or other high vacuum pump 284. The thermal vaporization/ionization-based detector 281 can function as an ultrahigh mass detector which operates by converting large ions into smaller fragments that are then measured by the detector.

There are three principal elements/aspects to instruments according to the invention that enable mass analysis of large ions with high resolution and mass accuracy. The first aspect of the inventive solution for high resolution mass spectroscopy of large molecules of mass generally greater than 30 KDa relates to ion introduction into the mass spectrometer. Ions with kinetic energies that are comparable or greater than the psuedo-potential well depth in the ion trap cannot be trapped. As is well known in the art, the initial kinetic energy of the ions generally increases with mass.

The inventive solution to the problem of large ion introduction generates an ion velocity distribution that centers around zero. Therefore, there will always be some fraction of the distribution that can be mass analyzed. This desired velocity distribution of ions in the mass spectrometer is created using the aerosol MALDI process. The key enabling new step for creating the zeroed velocity distribution from the ablation of the aerosol MALDI process is the complete vaporization of the particle or particles to be analyzed. In one embodiment, a single particle is vaporized.

Although not needed to practice the present claimed invention, the Inventors provide the following mechanism believed to explain the ability of the present invention to obtain a low velocity ion distribution. When the particle is completely vaporized, the ablation plume is necessarily isotropic and expands in all directions simultaneously. Conservation of momentum requires that the velocity distribution centers at zero with respect to the center of mass of the particle. Incomplete vaporization of aerosol MALDI particle characteristic of earlier aerosol MALDI work allows the plume expand against surfaces. As a result, the unablated portion of the particle provides a surface against which the MALDI plume expands. The velocity distribution of the MALDI plume rapidly approaches the distribution caused by MALDI expansion from a surface as the size of the unablated portion of the particle increases.

In contrast, the above described aerosol MALDI technique according to the invention permits some fraction of the ions created in the MALDI process inside an ion trap to be trapped regardless of their size or mass-to-charge ratio. Resolution in an ion trap is defined by the trap potentials and the manner they are applied. Resolution of an ion trap does not depend on the initial velocity distribution of the ions, trapping the ions does. Once trapped, the resolution of the ions depends only on the mass spectrometer.

The second part of the inventive solution to high resolution mass spectrometry of large ions is the mass spectrometer. A DIT mass spectrometer has essentially no mass limit because the trapping frequency used can be set to accommodate and eject essentially any value of m/z. The resolution of a DIT depends on the depth and reproducibility of the pseudo-potential well created as well as the speed with which the ions are scanned out of the trap. In general, deeper psuedo-potential wells and slower scan speeds provide better resolution. A significant advantage of a DIT is that the pseudo-potential well depth does not change as a function of mass across the entire spectrum. Consequently, the key parameter that defines the resolution in a digital ion trap (DIT) is the scan rate. Ding et al. (Ding, L.; Sudakov, M.; Brancia, F. L.; Giles, R.; Kumashiro, S. *J. Mass Spectrom.* 2004, 39, 471-484; hereafter "Ding") Ding demonstrated the effect of scan rate on resolution 1,500 Da, where scan speeds of 997, 200 and 39 Da/s, yielded resolutions (m/Δm) of 8,000, 12,000 and 19,000, respectively.

In Ding, the frequency was not actually scanned. Rather, the frequency was stepped. Resolution in this case is defined by the change in period of the potential with each step. The best reported resolution at 1,500 Da is 19,000 because that corresponds to the minimum increment in the period of the potential of 50 ps. Larger period steps produce correspondingly worse resolution. Interestingly, the resolution of a DIT actually gets better with increasing mass because the period of the potential gets longer while the minimum increment stays the same. The present Inventors calculated the maximum DIT resolution (50 ps) as a function m/z. Their calculation yielded a resolution of 14,000 at 1,500 Da. A resolution of 46,000 is expected at 17 KDa assuming 50 ps resolution. Better functions generators will provide better resolution and mass accuracy. 2 ps resolution is now possible suggesting that a resolution of 1.2 million is possible at 17 KDa. Resolution can also be improved using higher trapping voltages than the trapping voltages disclosed by Ding that were 2 kVpp, such as 10 kVpp.

The system element enabling the measurement of large ions is the detector. A preferred detector is a detector that vaporizes, fragments and ionizes the large ions ejected from or transmitted through the spectrometer. High temperature pyrolysis of a large ion creates many small molecular and atomic species. The burst of gaseous material that results from rapid transfer of thermal energy caused by impaction of a large ion onto a heated surface can be ionized and then detected with a conventional electron multiplier based detector. A burst of small ions hitting the detector thus can signify the presence of a large ion. The response of such a detector actually increases with increasing ion size unlike most detectors. Therefore, the critical issue for this type of detector is actually the smallest size ion that can be detected, rather than the largest.

There are two important issues that define the sensitivity of a pyrolysis-based detector (i.e., the smallest unit mass that can be detected). They are the concentration of background gaseous species in the detection chamber as defined by the chamber pressure with the pyrolysis detector active without any input particles/ions present and the flux of gaseous material evolving from the particle. The detection chamber pressure defines the baseline signal at the detector and limits the gain. The lower the chamber pressure, the lower the baseline signal at the detector, the higher the applied detector gain, the greater the detector response. Control of the flux of gaseous particle material from the particle into the ionization region controls the height of the signal above the background. For a given mass of gaseous material that evolves from a pyrolyzed particle into the ionization region, the greater the flux or number density of particle vapor the greater the signal level above the background, the greater the sensitivity.

One method for vaporizing, fragmenting and ionizing high molecular weight ions into a plurality of smaller ions is using a filament heated cup or chamber, or radiative heating and impaction onto a hot surface. A filament heated cup or chamber subsequently ionizes emerging vapors by electron impact, and then preferably detects the ions with a multiplier detector. An exemplary detector based on a filament heated cup is disclosed in U.S. Pat. No. 6,972,408 to Reilly (hereafter "Reilly"), Reilly being one of the present inventors. Such a detector permits detection of individual large ions and provides high sensitivity for large ions across a broad mass spectrum range.

Figure 3A:
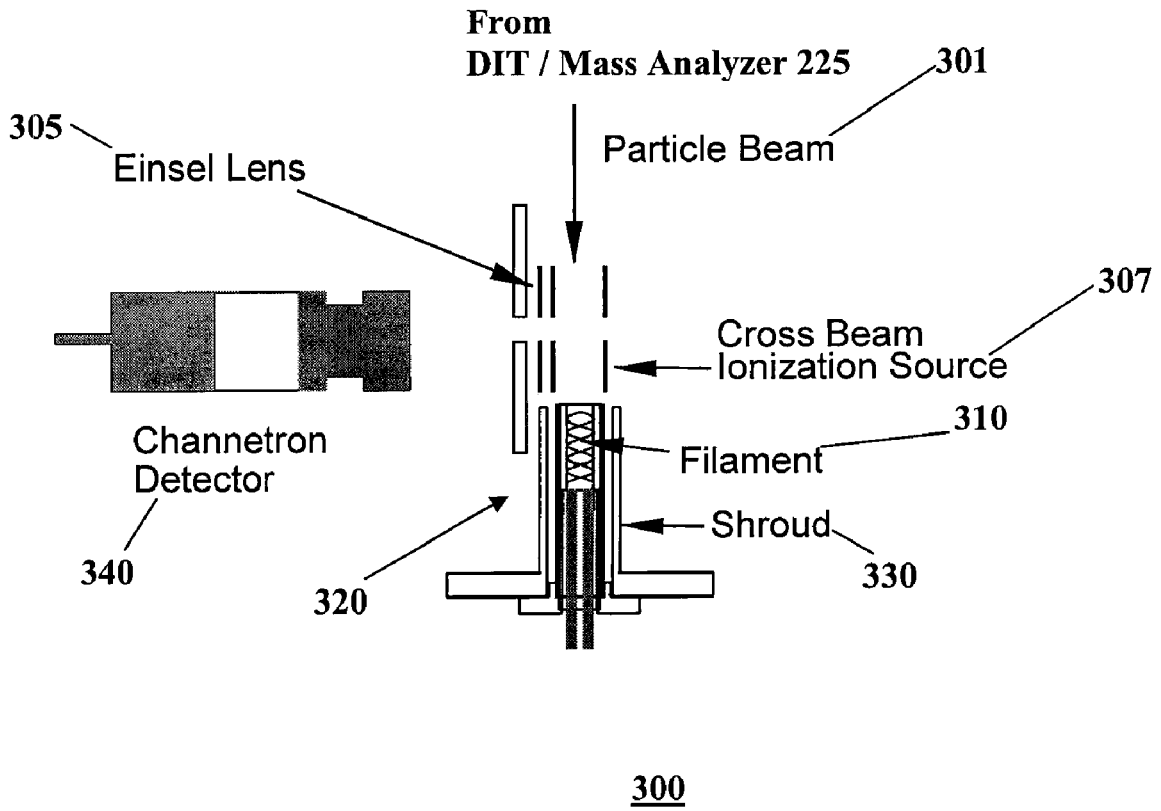
FIG. 3(*a*) is a cross sectional depiction of a pyrolysis-based particle detector. Particles impact into the filament-heated ceramic chamber and vaporize. The vapor plume expands into the ionization source where it is ionized by electron impact. The nascent analyte ions are then extracted and detected with an electron multiplier-based detector.
Figure 3B:
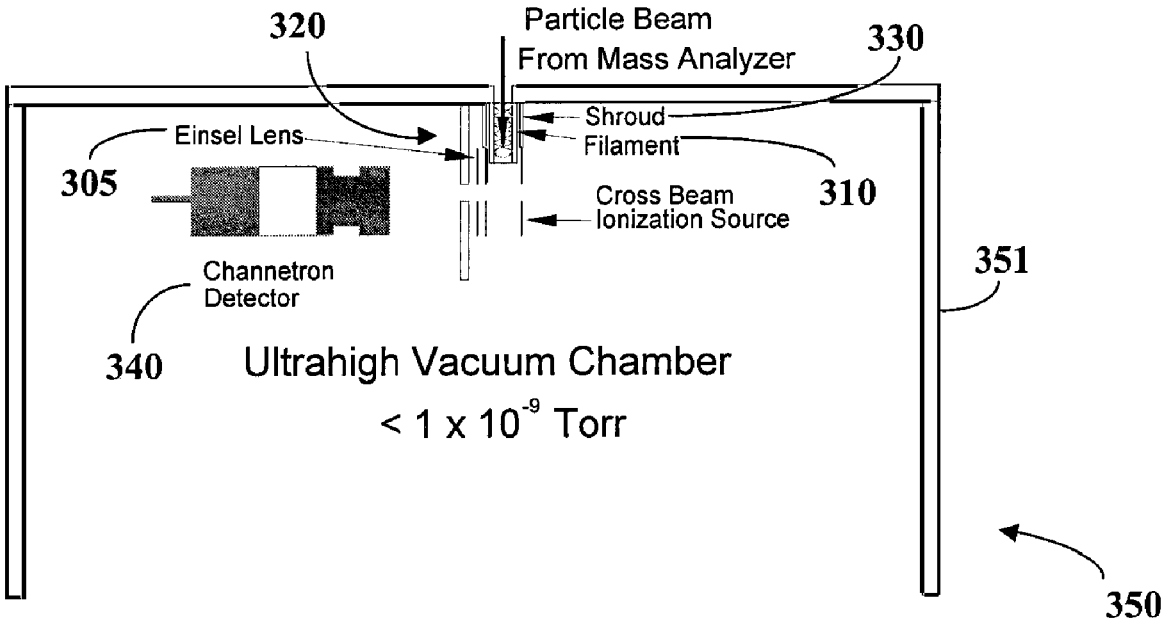

FIG. 3(*a*) shows a cross sectional depiction of an exemplary pyrolysis-based detector 300 that can be used with the present invention. The charged species that exit DIT/mass analyzer 225 shown in FIGS. 2(*a*) and (*b*) passes through a cross beam ionization source 307 into a cup region heated by filament 307 as they are impacted into the vaporization/ionization chamber 320. Higher cup temperatures yield better fragmentation into small molecular and atomic species and a greater gas cloud density. This heat can also heat the surrounding environment in the detection chamber 320. The filament heated cup includes a shroud 330 with a heat shield to minimize thermal transmission to the environment. Because the cross beam source 307 is located in close proximity to the glowing filament 310, it is preferably made out of thin sheet metal to reduce the heat transmission and absorption. In operation, particles from particle beam 301 impact into chamber 320 which is heated by filament 310 surrounded by shroud 315 and vaporize due to heating. Particles are generally heated to a high temperature (>1000° C.). The vapor plume from the particle expands out of the cup and into the cross beam source 307 where it is ionized by an electron beam normal to the plain of the page. The resulting electron impact generated ions are extracted out of the ion source 307 through an Einsel lens system 305 and into the electron multiplier-based detector, such as channeltron detector 340. The electron multiplier-based detector is not in thermal contact with the cross beam source 307. The baseline signal results from the gas molecules in the back ground ($1\times10^{-7}$ Torr) being randomly ionized and detected. This is roughly the limit of detection for these conditions because increasing the detector gain correspondingly increases the background signal.

Figure 4:
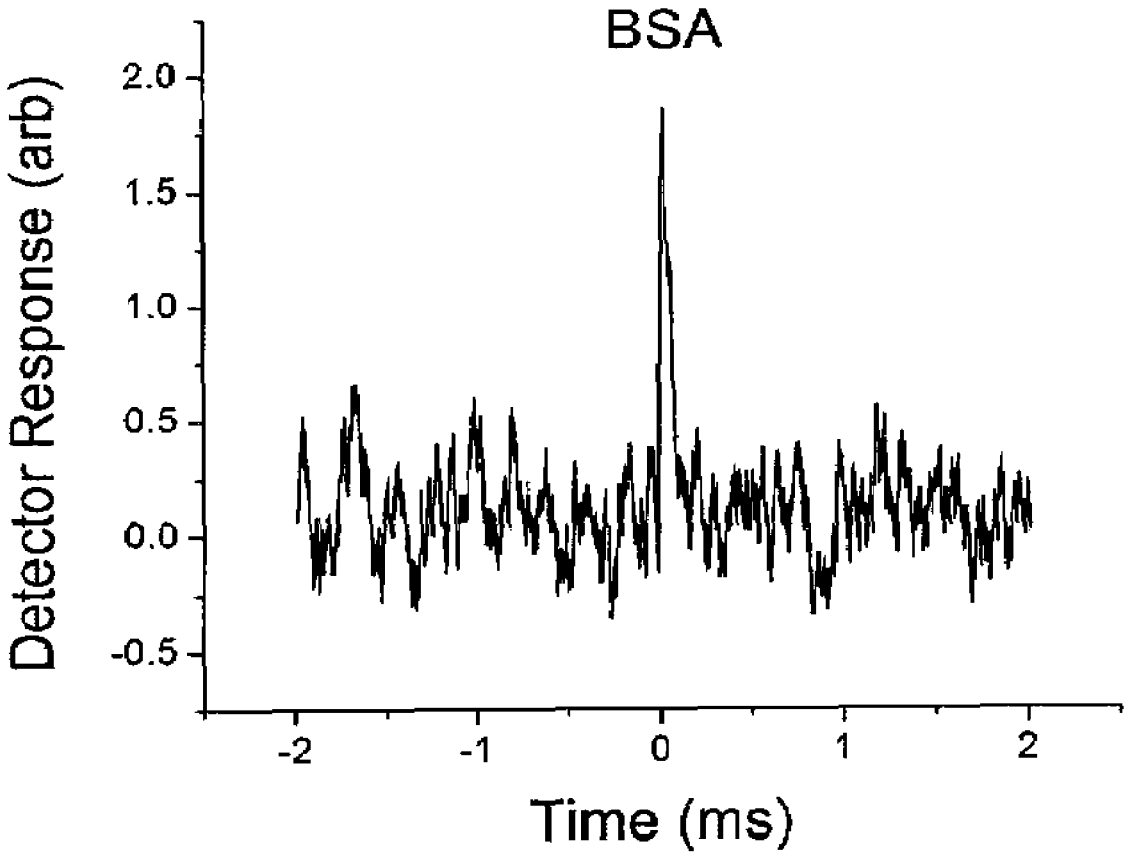
FIG. 4. shows averaged detector response data obtained from an individual bovine serum albumin molecule striking the detector at $1\times10^{-7}$ Torr.
Figure 5:
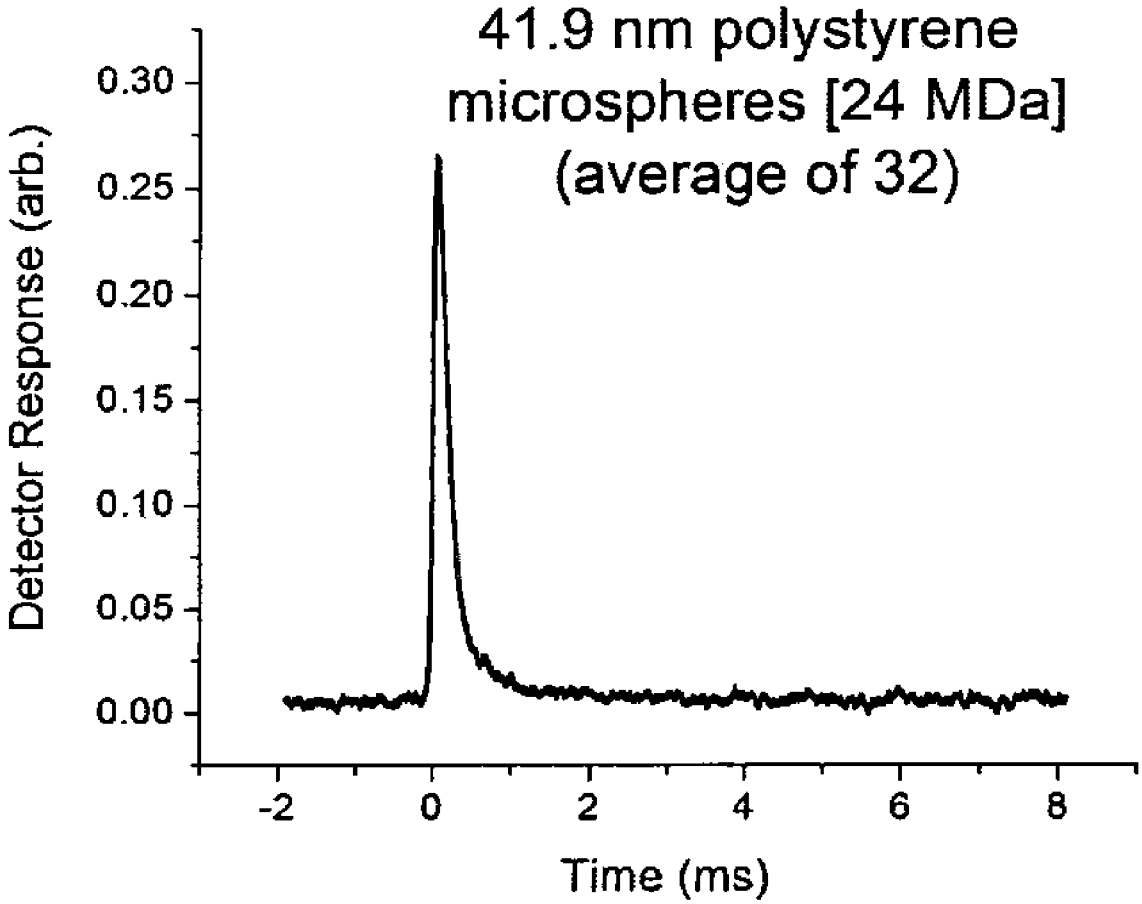
FIG. 5 shows averaged detector response data from 32 individual 42-nm polystyrene microspheres striking a detector.

Detector 300 or a detector based on Reilly provides a response which increases with increasing mass because larger particles yield larger bursts of gaseous fragments for ionization and detection. The figure of merit for this detector is the smallest individual particle that can be detected. FIG. 4 shows the response for such a detector from an individual bovine serum albumin (BSA) particle (66 KDa, 6.5 nm) striking the detector. This represents the smallest individual particle that can be detected with the setup used. However, the baseline of the signal from the detector results from ionization of background gas molecules in the detector chamber. FIG. 5 shows averaged detector response data from 32 individual 42-nm polystyrene microspheres striking the detector.

The detector chamber pressure during the experiments described above was approximately $1\times10^{-7}$ Torr. Therefore, the sensitivity of the detector could be markedly improved by reducing the detector chamber pressure. However, if the pyrolysis detector is placed in its own ultrahigh vacuum chamber at $1\times10^{-9}$ Torr or lower, then the baseline should correspondingly decrease and the detector can be set to higher gain with the particle signal being overwhelmed by the random signal from the background gas.

FIG. 3(*b*) is a cross sectional depiction of a modified pyrolysis-based particle detector 350. Features as in FIG. 3(*a*) are referenced as before. Detector 350 places the pyrolysis detector components comprising detection chamber 320, shroud 330, filament 310 and cross beam ionization source 307 in a separate ultra high vacuum chamber 351, which provides a pressure $<1\times10^{-9}$ torr. Detector 350 is expected to yield a factor of ten increase in sensitivity and will enable detection of individual particles well below 6 KDa. Another improvement provided by detector 350 comprises decreasing the depth of the filament heated cup and moving it closer to the center of the cross beam ion source 307. This will narrow the diffusion time of the gaseous material from the pyrolyzed particle to the center of the ion source 307. This will result in narrowing the temporal response and increasing the signal to noise ratio and will permit greater sensitivity and a greater particle counting rate. Greater particle counting rates are important to counting based quantitation. In operation, detector 350 has the particles pyrolyzed by passage though a heated tube into ion source 350. The gaseous material evolving from the particle would travel with the center of mass of the particle if the particle were not stopped by impaction. This arrangement will yield a much sharper temporal detector response and increase the particle counting rate. Unvaporized portions of the particle would continue on through the source and not affect detection. This design may greatly enhance the particle detection rate provided that the pyrolysis of the particle while it passes through the heated tube provides enough of a gas pulse to be detected.

The improvement provided by detector 350 should increase the sensitivity of the detector by more than an order of magnitude because the detector can be operated at much higher gain at the lower pressures. It is believed that this improvement may permit observation of individual particles at and perhaps below 1 KDa in mass. It is also important to note that the response of the detector depends on the total mass input so that ten 1 kDa molecules entering the detector will elicit the same response as one 10 kDa molecule. The ability to detect individual particulate ions means ion counting measurements can be performed on intact proteins, RNA, DNA and viruses. Ion counting is one of the best methods for performing quantitative analysis.

As noted above, the present invention permits the mass analysis of large ions, such as proteins. It will also permit the measurement of complex mixtures of large ions and proteins too. For example, whole protein lysates may be mass analyzed and quantified. Moreover, using a DIT, they can be precisely isolated and then fragmented by a variety of techniques to provide an identifiable spectrum. Systems and methods according to the invention will significantly increase the ability to perform proteomic and genetic analysis.

Following mass analysis, additional analysis can be performed. The analyte can be precisely mass isolated and then subjected to any combination of the following tandem mass spectrometry techniques, including electron capture dissociation (ECD) or electron transfer dissociation (ETD), photodissociation (PD) and collision-induced dissociation (CID). These tandem mass spectrometry techniques can be applied over and over again to provide sequence information or just a positive identification because the frequency of the potential can be instantaneously changed to optimize the psuedopotential well for the analyte ion of interest.

Benefits of the present application include high resolution mass spectrometry in the high mass range above m/z of 20,000. It will also enable accurate and well resolved measurement of whole proteins and other large ions. The invention will also greatly facilitate the ability to perform proteomic analysis by permitting the measurement of complex mixtures of whole proteins. This means that the expression of proteins as a function of environment and genetic traits can be rapidly determined. With this technique, the proteins associated with various functions can be defined. Considering the current capabilities in proteomics, this is a quantum leap forward in ability. This instrument and technique will have a miriad of applications to biological analysis once its capabilities have been demonstrated.

While there has been shown and described what are at present considered the preferred embodiments of the invention, it will be obvious to those skilled in the art that various changes and modifications can be made therein without departing from the scope of the invention defined by the appended claims.

We claim:

1. A method for analyzing high molecular weight analytes, comprising the steps of:

providing at least one matrix-containing particle inside an ion trap, wherein at least one high molecular weight analyte molecule is provided within said matrix-containing particle;

performing matrix assisted laser desorption/ionization (MALDI) on said high molecular weight particle while inside said ion trap, wherein a laser power used for ionization is sufficient to completely vaporize said particle and form at least one high molecular weight analyte ion, but is low enough to avoid fragmenting said high molecular weight analyte ion;

ejecting said high molecular weight analyte ion out from said ion trap as a function of mass-to-charge ratio, and detecting said high molecular weight analyte ion using a detector.

2. The method of claim 1, wherein said MALDI comprises aerosol MALDI.

3. The method of claim 1, wherein an average kinetic energy of said ion is less than an electronic charge of said ion multiplied by an applied pseudo-potential well depth in said mass spectrometer.

4. The method of claim 1, wherein a size of said particle is $<1$ μm.

5. The method of claim 1, wherein said detecting step comprises pyrolyzing said high molecular weight ion into small fragments, ionizing said fragments into fragment ions and subsequently detecting said fragment ions.

6. The method of claim 5, wherein a filament heated cup or chamber-based detector is used for said pyrolyzing.

7. The method of claim 1, wherein said providing step comprises passing said high molecular weight analyte and matrix-containing particle through an aerodynamic lens system.

8. The method of claim 1, wherein said high molecular weight analyte molecule has a mass $>20$ kDa.

9. The method of claim 8, wherein said high molecular weight analyte molecule comprises a protein.

10. The method of claim 1, wherein said detector for said detecting is performed in an ultra-high vacuum chamber, wherein a pressure in said ultra-high vacuum chamber is $<1\times10^{-9}$ torr.

11. The method of claim 1, wherein said providing step comprises introducing said analyte containing particles into said ion trap using an aerodynamic lens-based inlet system.

12. An aerosol matrix assisted laser desorption/ionization (MALDI) system for analyzing high molecular weight analytes, comprising:

structure for providing at least one matrix-containing particle inside a digital ion trap (DIT), wherein at least one high molecular weight analyte molecule is provided within said matrix-containing particle;

a laser having a beam aligned with said high particle for ionizing said high molecular weight analyte while in said DIT, said laser having a laser controller, said laser controller controlling output laser power to be sufficient for ionization and to completely vaporize said particle and form at least one high molecular weight analyte ion, but low enough to avoid fragmenting said high molecular weight analyte ion, and a mass spectrometer comprising a detector for receiving and analyzing said high molecular weight analyte ion, said detector comprising a pyrolyzing and ionizing detector.

13. The system of claim 12, wherein said structure for providing at least one matrix-containing particle inside said DIT comprises an aerodynamic lens-based inlet system.

14. The system of claim 12, wherein said pyrolyzing and ionizing detector comprises a heated filament for pyrolyzing said particle into gaseous material and an ionization source for ionizing said gaseous material.

15. The system of claim 12, wherein said pyrolyzing and ionizing detector comprises a shrouded filament, said shroud including a heat shield.

16. The system of claim 12, further comprising a ultra-high vacuum chamber for said pyrolyzing and ionizing detector, wherein a pressure in said ultra-high vacuum chamber is $<1\times10^{-9}$ torr.

* * * * *